US006170223B1

(12) United States Patent
Kurose

(10) Patent No.: US 6,170,223 B1
(45) Date of Patent: Jan. 9, 2001

(54) PANEL ASSEMBLY

(75) Inventor: Kazutoshi Kurose, Kanagawa (JP)

(73) Assignee: Gomeigaisha Kurose & Co., Hiroshima (JP)

( * ) Notice: Under 35 U.S.C. 154(b), the term of this patent shall be extended for 0 days.

(21) Appl. No.: 09/217,260

(22) Filed: Dec. 21, 1998

(30) Foreign Application Priority Data

Dec. 26, 1997 (JP) ..... 9-366632
Jan. 27, 1998 (JP) ..... 10-027874

(51) Int. Cl.[7] ..... E04B 2/00

(52) U.S. Cl. ..... 52/763; 52/762; 52/764; 52/773; 52/775; 52/579; 52/581; 52/588.1

(58) Field of Search ..... 52/579, 581, 588.1, 52/762, 763, 764, 773, 774, 775, 522, 538, 542

(56) References Cited

U.S. PATENT DOCUMENTS

| | | | | |
|---|---|---|---|---|
| 2,859,494 | * | 11/1958 | Hull | 52/542 |
| 2,888,983 | * | 6/1959 | Toti | 52/542 |
| 3,242,626 | * | 3/1966 | Blok | 52/478 |
| 3,313,075 | * | 4/1967 | Buchmeier | 52/489 |
| 3,336,705 | * | 8/1967 | Vecchiarelli et al. | 52/222 |
| 3,347,009 | * | 10/1967 | Meddick | 52/542 |
| 3,410,043 | * | 11/1968 | Rijnders | 52/762 |
| 3,412,516 | * | 11/1968 | Lindstrom | 52/492 |
| 3,548,556 | * | 12/1970 | Vermeulen | 52/492 |
| 4,134,244 | * | 1/1979 | Sjolander | 52/542 |
| 4,833,839 | * | 5/1989 | Kurose | 52/762 |
| 4,964,257 | * | 10/1990 | Kurose | 52/741 |

FOREIGN PATENT DOCUMENTS

| | | |
|---|---|---|
| 1022666 | 3/1966 | (GB) . |
| 46-3434 | 1/1971 | (JP) . |

* cited by examiner

*Primary Examiner*—Carl D. Friedman
*Assistant Examiner*—Dennis L. Dorsey
(74) *Attorney, Agent, or Firm*—Nilles & Nilles SC

(57) ABSTRACT

A panel assembly of the present invention comprises a stringer and a plurality of sheet panels each having a curved portion extending downward at one side thereof and a curved portion extending upward at the other side thereof. The stringer has on the top thereof a plurality of panel engaging portions adjacent to one another, each having upstream side convex portion, around which the curved portion of the sheet panel extending downward is hooked, a downstream side concave portion, into which the curved portion of the sheet panel extending upward Is fitted, and a planar portion extending from the upstream side convex portion to the downstream side concave portion. The planar portion of the panel engaging portion of the stringer is inclined downward from the upstream side convex portion to the downstream side concave portion. An upper portion of the concave portion of the panel engaging portion having a groove, into which a tip end of the curved portion of the sheet panel extending upward is fitted.

10 Claims, 4 Drawing Sheets

PANEL ASSEMBLY

BACKGROUND OF THE INVENTION

1. Field of the Invention

The present invention relates to a panel assembly, and more particularly, relates to a panel assembly having a stringer and elongated sheet panels clampingly secured to the stringer.

2. Description of the Prior Art

A panel assembly is disclosed in the Japanese Patent Publication No. 46-3434.

The conventional panel assembly comprises a stringer 1 and a plurality of sheet panels 2, as shown in FIGS. 1 and 2.

The stringer 1 is formed of a plate of aluminum alloy, for example, by roll forming in a predetermined figure and bent so as to have a U-shaped cross-section as shown in FIG. 2. The stringer 1 has projections 3 each having convex portions 4 at both sides thereof and recesses 5 each having concave portions 6 at both sides thereof. Each of said projections 3 and each of said recesses 5 are arranged alternately with a desired interval on the top of each of side walls of the stringer 1.

Each of said sheet panels 2 is formed of a baking finished plate of aluminum alloy or plastic and has curved portions 7 at both sides thereof.

A first sheet panel 2 facing upward is clampingly secured to the recess 5 formed between the projections 3 of the stringer 1 and a second sheet panel 2 facing downward is put on the projection 3 of the stringer 1, so that the two curved portions 7 of the second panel element 2 are hooked around the two curved portions 7 of the first and third sheet panel 2 clamped in the recesses 5 to form a panel assembly.

As stated above, in the conventional panel assembly, it is necessary to arrange the panel elements 2 facing upward and facing downward alternately and to bring them into engagement with the projections 3 and recesses 5 of the stringer 1, respectively, and accordingly the work becomes hard and the panel assembly becomes expensive.

SUMMARY OF THE INVENTION

An object of the present invention is to obtain a panel assembly comprising a stringer, a plurality of sheet panels each having a curved portion extending downward at one side thereof and a curved portion extending upward at the other side thereof, and an end sheet panel having bent portions extending downward at both sides thereof, said stringer having on the top thereof a plurality of panel engaging portions adjacent to one another and an end panel engaging portion located at the end portion thereof, each of said panel engaging portions having an upstream side convex portion, around which the curved portion of the sheet panel extending downward is hooked, a downstream side concave portion, into which the curved portion of the sheet panel extending upward is fitted, and a planar portion extending from said upstream side convex portion to said downstream side concave portion, and said end panel engaging portion of the stringer having curved edges at both ends thereof, around which the bent portions of the end sheet panel are hooked, respectively.

Another object of the present invention is to obtain a panel assembly comprising a stringer, and a plurality of sheet panels each having a curved portion extending downward at one side thereof and a curved portion extending upward at the other side thereof, said stringer having on the top thereof a plurality of panel engaging portions adjacent to one another, each of said panel engaging portions having an upstream side convex portion, around which the curved portion of the sheet panel extending downward is hooked, a downstream side concave portion, into which the curved portion of the sheet panel extending upward is fitted, and a planar portion extending from said upstream side convex portion to said downstream side concave portion, and an upper portion of said concave portion of the panel engaging portion having a groove, into which a tip end of said curved portion of the sheet panel extending upward Is fitted.

Further object of the present invention is to obtain a panel assembly comprising a stringer, a plurality of sheet panels each having a curved portion extending downward at one side thereof and a curved portion extending upward at the other side thereof, and an end sheet panel having bent portions extending downward at both sides thereof, said stringer having on the top thereof a plurality of panel engaging portions adjacent to one another, and an end panel engaging portion located at the end portion thereof, each of said panel engaging portions having an upstream side convex portion, around which the curved portion of the sheet panel extending downward is hooked, a downstream side concave portion, into which the curved portion of the sheet panel extending upward is fitted, and a planar portion extending from said upstream side convex portion to said downstream side concave portion, said end panel engaging portion of the stringer having curved edges at both ends thereof, around which the bent portions of the end sheet panel are hooked, respectively, and an upper portion of said concave portion of the panel engaging portion having a groove, into which a tip end of said curved portion of the sheet panel extending upward is fitted.

The plurality of sheet panels include at least one sheet panel different in width from the other sheet panels.

The planar portion of the panel engaging portion of the stringer is inclined downward from said upstream side convex portion to said downstream side concave portion.

At least one panel engaging portion of the stringer is engaged with no sheet panel.

The foregoing and other objects and features of the present invention will be further described with reference to the accompanying drawings by way of example according to the present invention. The detailed description and drawings are merely illustrative rather than limiting, the scope of the intention being defined by the appended claims and equivalents thereof.

DESCRIPTION OF THE PREFERRED EMBODIMENT

Embodiments of the present invention will now be explained with reference to the drawings attached hereto.

Figure 3:
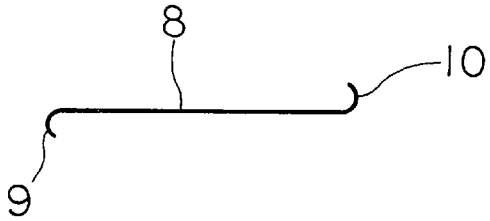
FIG. 3 shows a front view of a sheet panel of a panel assembly of the present invention.
Figure 4:
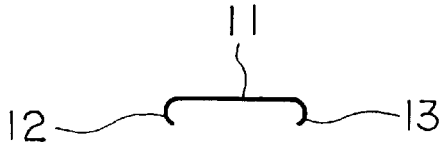
FIG. 4 shows a front view of the other sheet panel of the panel assembly of the present invention.
Figure 5:
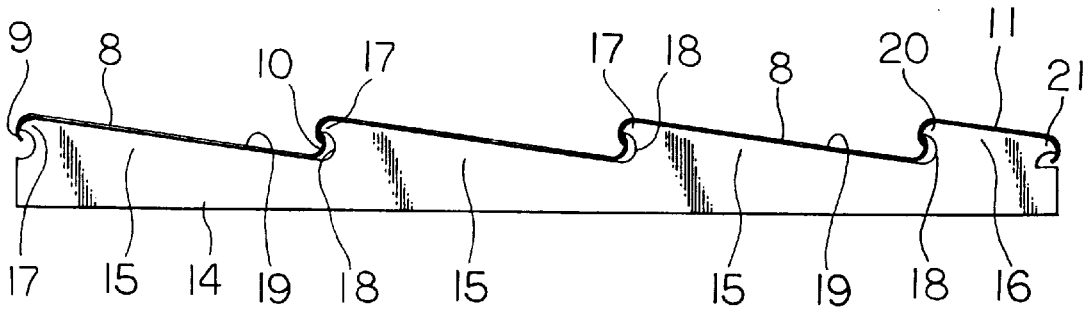
FIG. 5 shows a front view of the panel assembly of the present invention.

A panel assembly in an embodiment of the present invention comprises a plurality of sheet panels 8 each having an inwardly curved portion 9 extending downward at one side thereof and an inwardly curved portion 10 extending upward at the other side thereof as shown in FIG. 3, and an end sheet panel 11 having inwardly curved portions 12 and 13 extending downward at both ends thereof as shown in FIG. 4, and a stringer 14 as shown In FIG. 5.

Said stringer 14 has on the top thereof a plurality of panel engaging portions 15 adjacent to one another, and an end panel engaging portion 16 located at one end portion thereof.

Each of the panel engaging portions 15 comprises an upstream side convex portion 17, around which the curved end portion 9 of the sheet panel 8 extending downward is hooked, a downstream side concave portion 18, into which the curved portion of the sheet panel 8 extending upward is fitted, and a planar portion 19 inclined downward at an angle of 8.1 degrees, for example, from said upstream side convex portion 17 to said downstream side concave portion 18.

Said end panel engaging portion 16 has curved edges 20 and 21 at both ends thereof, around which the curved portions 12 and 13 of the end sheet panel 11 are hooked, respectively.

The panel assembly of the present invention can be fabricated in the following manner.

The curved end portions 9 and 10 of a first sheet panel 8 are engaged with the upstream side convex portion 17 and the downstream side concave portion 18 of a first panel engaging portion 15 of the stringer 14, respectively, so that the first sheet panel 8 is clampingly secured to the first panel engaging portion 15. The curved end portion 9 of a second sheet panel 8 is then engaged with the upstream side convex portion 17 of a second panel engaging portion 15, so that the tip end of the curved end portion 9 of the second sheet panel 8 is brought into abutment with the curved end portion 10 of the first sheet panel 8. Then, the curved end portion 10 of the second sheet panel 8 is engaged with the downstream side concave portion 18 of the second panel engaging portion 15, so that the second sheet pane 8 is clampingly secured to the second panel engaging portion 15.

The above operation is repeated, and finally, the curved portions 12 and 13 of the end sheet panel 11 are engaged with the curved edges 20 and 21 of the end panel engaging portion 16 of the stringer 14, so that the tip end of said curved portion 12 of the end sheet panel 11 is brought into abutment with the curved portion 10 of a final panel 3 engaged with the downstream side concave portion 18 of a final panel engaging portion 15.

According to the embodiment of the present invention, the upstream side sheet panel 8 clampingly secured to the corresponding panel engaging portion 15 of the stringer 14 is held by the downstream side sheet panel 8, and the final sheet panel 8 can be secured to the corresponding panel engaging portion 15 of the stringer 14 by the end sheet panel 11 clampingly secured to the end panel engaging portion 16.

Figure 6:
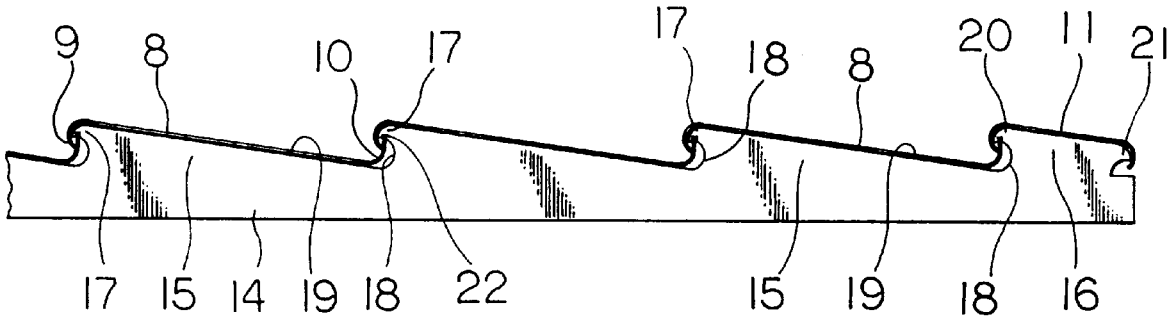
FIG. 6 and 8 shows a front view of a panel assembly of the other embodiment according to the present Invention.
Figure 7:
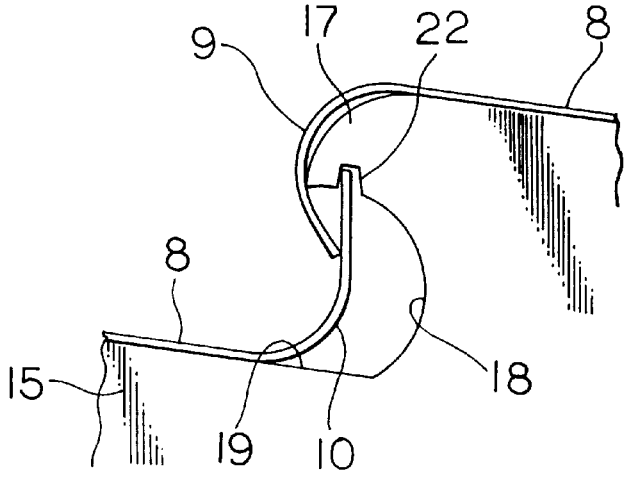
FIG. 7 is an enlarged front view of a portion of FIG. 6.
Figure 8:
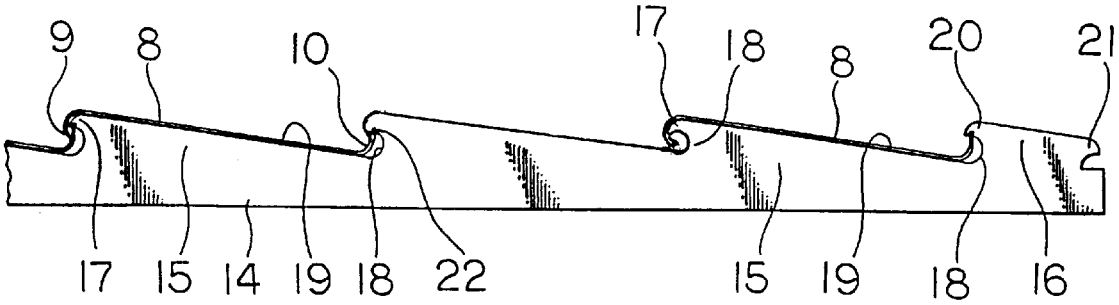

In the other embodiment of the present invention, as shown in FIGS. 6 and 7, a groove 22 for receiving a tip end of the curved portion 10 of said sheet panel 8 is provided on an upper portion of the downstream side concave portion 18 of each of said panel engaging portion 15.

According to this embodiment of the present invention, the panel assembly can be assembled in such a manner that the curved portions 12 and 13 of the end sheet panel 11 are engaged with the curved edges 20 and 21 of the end panel engaging portion 16 of the stringer 14, at first. The tip end of the curved portion 10 of a (n)th sheet panel 8 is inserted into the groove 22 of the downstream side concave portion 18 of a corresponding (n)th panel engaging portion 15 adjacent to said end panel engaging portion 16, then the curved portion 9 of the (n)th sheet panel 8 is engaged with the upstream side convex portion 17 of the (n)th panel engaging portion 15, so that the (n)th sheet panel 8 is clampingly secured to the (n)th panel engaging portion 15 of the stringer 14, and then a (n−1)th sheet panel 8 is clampingly secured to a corresponding (n−1)th panel engaging portion 15 in the similar manner and such operation is repeated.

As stated above, the panel assembly of the present invention can easily be assembled.

Various modifications may be made to the present invention, within the scope of the appended claims. For example, among the sheet panels 8, at least one sheet panel different in width from the other sheet panels can be used. In such a case, however, it is necessary to coincide the configuration of the panel engaging portion 15 of the stringer 14 with the width of such sheet panel 8. The stringer 14 in the form of a plate can be used instead of the stringer of a U-shaped or substantially U-shaped cross-section.

Further, if the height of the stringer 14 is reduced as possible, the stringer 14 can be bent along any figure of the curved walls, building awnings, roofs and the like.

Furthermore, in view of the art, it is not always necessary to engage all panel engaging portions 15 with the sheet panels 8.

Figure 1:
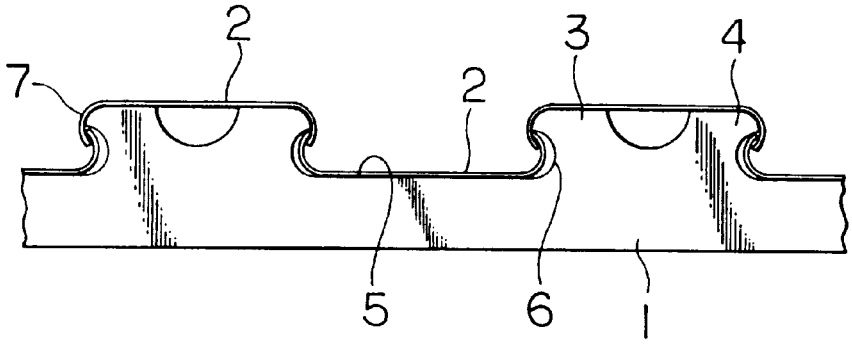
PRIOR ART FIG.1
FIG. 1 shows a front view of a conventional panel assembly.
Figure 2:
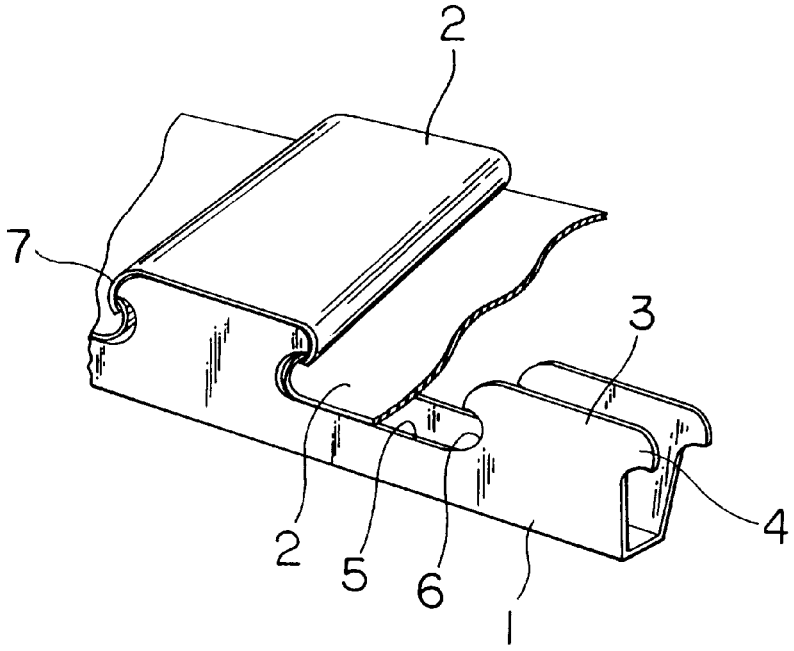
PRIOR ART FIG.2
FIG. 2 shows a perspective view of the panel assembly shown in FIG. 1.

If the distance between the end of the upstream side convex portion 17 and the groove 22 of the panel engaging portion 15 is the same with the width of the corresponding sheet panel 8, the curved portion 10 of the sheet panel 8 is deformed upright so that the tip end of the curved portion 9 of the following sheet panel 8 is abutted tightly as shown in FIG. 7, when the tip end of the curved portion 10 is inserted into the groove 22 of the corresponding downstream side concave portion 18, whereby adjacently mounted sheet panels 8 have very tightly engaging surfaces provide excellent pressure fits therebetween and provide an excellent watertight structure to prevent the passage of water between such engaging surfaces. The curved portion 10 of the sheet panel 8 can be formed as shown in FIG. 1, previously, different from the curved portion 9 of the sheet panel 8 in figure.

The curved portion 12 or 13 of the end sheet panel 11 can be replaced by a portion bent normally. In the embodiment of the present invention shown in FIGS. 6 and 7, said end sheet panel 11 and the corresponding end panel engaging portion 16 of the stringer 14 may be omitted.

What is claimed is:

1. A panel assembly comprising:

a stringer including a first end, a second end, and a plurality of adjacent panel engaging portions therebetween and an end panel engaging portion located adjacent the second end of the stringer;

wherein each of the panel engaging portions include a convex portion formed on a first end of the panel engaging portion, a concave portion formed on a second end of the panel engaging portion, and a planar portion therebetween;

wherein the end panel engaging portion includes a first curved edge formed on a first end of the end panel engaging portion and a second curved edge formed on a second end of the end panel engaging portion;

a plurality of sheet panels having a first end and a second end, wherein the first end includes a downwardly extending curved portion and the second end includes an upwardly extending curved portion;

an end sheet panel having a first end and a second end, wherein each of the first and second ends include a downwardly extending bent portion;

wherein the downwardly extending curved portion of each of the sheet panels hooks around the convex portions of each of the panel engaging portions;

wherein the upwardly extending curved portion of each of the sheet panels is fit into the concave portions of each of the panel engaging portions; and wherein the downwardly extending bent portions of the end sheet panel hook around the first and second curved edges of the end panel engaging portion, respectively.

2. The panel assembly according to claim 1, wherein the plurality of sheet panels includes at least one sheet panel that is different in width than the other sheet panels.

3. The panel assembly according to claim 1, wherein each of the planar portions of the panel engaging portions is downwardly inclined from the first end of the panel engaging portion to the second end of the panel engaging portion.

4. A panel assembly comprising:

a stringer including a first end, a second end, and a plurality of adjacent panel engaging portions therebetween;

wherein each of the panel engaging portions include a convex portion formed on first end of the panel engaging portion, a concave portion formed on a second end of the panel engaging portion, and a planar portion therebetween;

a plurality of sheet panels having a first end and a second end, wherein the first end includes a downwardly extending curved portion and the second end includes an upwardly extending curved portion;

wherein the downwardly extending curved portion of each of the sheet panels hooks around the convex portions of each of the panel engaging portions;

wherein the upwardly extending curved portion of each of the sheet panels is fit into the concave portions of each of the panel engaging portions; and wherein a tip formed on each of the upwardly extending curved portions of the sheet panels is fit into a groove formed in an upper portion of each of the concave portions of the panel engaging portions.

5. The panel assembly according to claim 4, wherein the plurality of sheet panels includes at least one sheet panel that is different in width than the other sheet panels.

6. The panel assembly according to claim 4, wherein each of the planar portions of the panel engaging portions is downwardly inclined from the first end of the panel engaging portion to the second end of the panel engaging portion.

7. A panel assembly comprising:

a stringer including a first end, a second end, and a plurality of adjacent panel engaging portions therebetween and an end panel engaging portion located adjacent the second end of the stringer;

wherein each of the panel engaging portions include a convex portion formed or first end of the panel engaging portion, a concave portion formed on a second end of the panel engaging portion, and a planar portion therebetween;

wherein the end panel engaging portion includes a first curved edge formed on first end of the end panel engaging portion and a second curved edge formed on a second end of the end panel engaging portion;

a plurality of sheet panels having a first end and a second end, wherein the first end includes a downwardly extending curved portion and the second end includes an upward extending curved portion;

an end sheet panel having a first end and a second end, wherein each of the first and second ends include a downwardly extending bent portion;

wherein the downwardly extending curved portion of each of the sheet panels hooks around the convex portions of each of the panel engaging portions;

wherein the upwardly extending curved portion of each of the sheet panels is fit into the concave portions of each of the panel engaging portions;

wherein the downwardly extending bent portions of the end sheet panel hook around the first and second curved edges of the end panel engaging portion, respectively; and wherein a tip formed on each of the upwardly extending curved portions of the sheet panels is fit into a groove formed in an upper portion of each of the concave portions of the panel engaging portions.

8. The panel assembly according to claim 7, wherein the plurality of sheet panels includes at least one sheet panel that is different in width than the other sheet panels.

9. The panel assembly according to claim 7, wherein each of the planar portions of the panel engaging portions is downwardly inclined from the first end of the panel engaging portion to the second end of the panel engaging portion.

10. The panel assembly according to claim 7, wherein at least one panel engaging portions of the stringer is not engaged with a sheet panel.

* * * * *